United States Patent [19]

Kojima et al.

[11] Patent Number: 4,558,565

[45] Date of Patent: Dec. 17, 1985

[54] EXHAUST GAS CLEANING DEVICE FOR INTERNAL COMBUSTION ENGINE

[75] Inventors: Akikazu Kojima, Hamamatsu; Shigeru Kamiya, Chiryu, both of Japan

[73] Assignee: Nippon Soken, Inc., Nishio, Japan

[21] Appl. No.: 475,625

[22] Filed: Mar. 15, 1983

[30] Foreign Application Priority Data

Mar. 16, 1982 [JP] Japan ..... 57-41557
Mar. 20, 1982 [JP] Japan ..... 57-45046
Jun. 21, 1982 [JP] Japan ..... 57-106390

[51] Int. Cl.[4] ..... F01N 3/02

[52] U.S. Cl. ..... 60/286; 55/282; 55/312; 55/466; 55/DIG. 30; 60/288; 60/303; 60/311

[58] Field of Search ..... 60/288, 311, 303, 286; 55/212, 312, 282, 466, DIG. 10, DIG. 30

[56] References Cited

U.S. PATENT DOCUMENTS 4,211,075 7/1980 Ludecke ..... 60/311
4,381,643 5/1983 Stark ..... 60/303
4,450,682 5/1984 Sato ..... 55/482

*Primary Examiner*—Douglas Hart

*Attorney, Agent, or Firm*—Cushman, Darby & Cushman

[57] ABSTRACT

An exhaust gas cleaning device for collecting and burning off particulates within exhaust gases discharged from an internal combustion engine of an automobile or the like is disclosed. The device comprises a filter member which is disposed in an exhaust gas passage of the engine for collecting particulates within exhaust gases, an electrically heating member which is disposed on or near the upstream end of the filter member for igniting and burning off the collected particulates, a by-pass passage having a flowing resistance smaller than that of the filter member, which is communicated with the upstream side and the downstream side of the filter member for flowing most of the exhaust gases without passing the filter member at the filter member regenerating time, a valve means which is disposed in the by-pass passage for controlling the exhaust gas amount flowing into the by-pass passage and the filter member by opening or closing the by-pass passage and a valve control means which controls the valve opening so as to flow a small amount of exhaust gases enough to supply the most proper amount of oxygen to the filter member for burning off the collected particulates, into the filter member when said filter member is regenerated.

12 Claims, 22 Drawing Figures

EXHAUST GAS CLEANING DEVICE FOR INTERNAL COMBUSTION ENGINE

BACKGROUND OF THE INVENTION

The present invention relates to an exhaust gas cleaning device for collecting particulates within exhaust gases discharged from an internal combustion engine of an automobile or the like, and cleaning exhaust gases by burning off the collected particulates by means of a heater member.

Particulates collecting devices provided with a filter member made of a ceramic honeycomb structure or a ceramic foamed body, have been proposed for collecting particulates such as carbon particles contained within exhaust gases. In these devices, the flowing resistance of the filter member increases as the particulates accumulate the filter member to reduce the output of an engine. In addition, the accumulated particulates fall from the filter member to reduce the filtering efficiency thereof.

Therefore, it is required to regenerate the filter member by periodically removing the particulates from the filter member.

As the filter member regenerating means, it has been proposed to mount a heater on the filter member for heating the collected particulates to be burnt off. However, in this device, since the exhaust gas temperature is lower than the ignition point of carbon particulates under the normal driving condition of an automobile, the heater is cooled by the exhaust gases so that the particulates are obstructed from being ignited or the flame is blown out by the exhaust gas flow.

In order to improve the ignitability of the collected particulates and in order to prevent the ignited particulates from being blown out, it has been proposed to divide an exhaust gas passage communicated with the engine into two divergent passages and to provide a filter member in each of two divergent passages and a diverter valve on the upstream side or the downstream side of the filter members. By this device having the above structure, exhaust gases are selectively introduced into one of two passages while the filter member of the other passage is heated to burn off the collected particulates.

However, while one of two divergent passages of this device is closed, pressure loss in the filter member of the other divergent passage increases and the flowing speed of the exhaust gases also increases.

The increase in pressure loss makes the durability worse and reduces the output of the engine.

And due to the increase in flowing speed, the particulates collected by the filter member are apt to be blown off when the valve is changed. As a result, the filtering efficiency is reduced.

The above described problem can be overcome by providing a large sized filter member in each of the divergent passages.

However, this device requires two large casings for accommodating such large sized filter members so that the device becomes large.

In addition, while the particulates collected by one of the filter members are heated by the heater, the exhaust gases are not supplied thereto so that a sufficient amount of oxygen is not supplied to the filter member. Therefore, all of the collected particulates cannot be burnt off.

Accordingly, one object of the present invention is to provide an exhaust particulates cleaning device for an engine, having a single filter element and a heater for burning off the particulates collected by the filter member, of which the construction is simple and filter regenerability is excellent.

Another object of the present invention is to provide an exhaust particulates cleaning device for an engine, wherein ignitability and combustibility of collected particulates are improved by controlling the exhaust gas amount supplied to the filter member at the filter member regenerating time.

Still another object of the present invention is to provide an exhaust particulates cleaning device having a means for controlling the exhaust gas amount to be supplied to the filter member into the amount required for regenerating the filter member in accordance with the engine driving condition.

SUMMARY OF THE INVENTION

The exhaust particulates cleaning device of the present invention comprises a filter member which is disposed in an exhaust gas passage of an internal combustion engine for collecting particulates within exhaust gases; an electrically heating means which is disposed on or near the upstream end of the filter member for igniting and burning off the collected particulates; a by-pass passage having a flowing resistance smaller than that of the filter member, which is communicated with the upstream side and the downstream side of the filter member for flowing most of the exhaust gases without passing the filter member at the filter member regenerating time; and a valve means which is disposed in the by-pass passage for controlling the exhaust gas amount flowing into the by-pass passage and the filter member by opening or closing the by-pass passage.

Furthermore, the exhaust particulates cleaning device is further provided with a valve control means which controls the valve opening so as to flow a small amount of exhaust gases enough to supply the most proper amount of oxygen to the filter member for burning off the collected particulates, into the filter member when the filter member is regenerated.

DETAILED DESCRIPTION OF THE INVENTION

Hereinafter, the present invention will be explained in accordance with the several embodiments with reference to the drawings.

Figure 1:
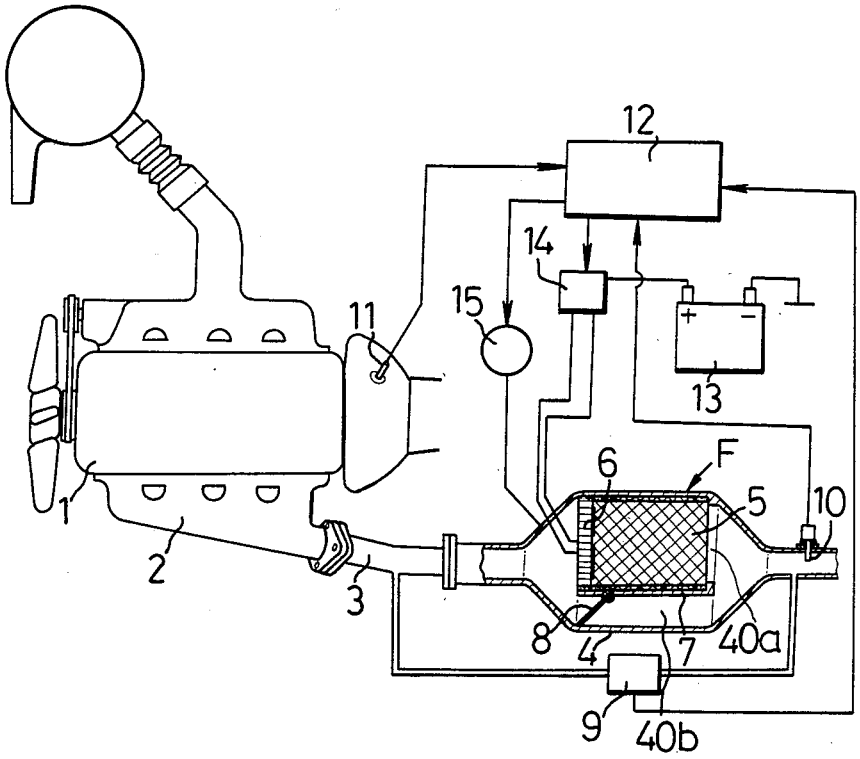
FIG. 1 is a schematic view of an exhaust gas system for an engine, which is provided with an exhaust particulates cleaning device according to the present invention.

FIG. 1 is a schematic view of an exhaust system of an internal combustion engine which is provided with an exhaust particulates cleaning device according to the present invention.

The reference numeral 1 designates an internal combustion engine such as a diesel engine, 2 designates an exhaust manifold, 3 designates an exhaust pipe and F designates an exhaust particulates cleaning device which is provided in the exhaust pipe 3.

The exhaust particulates cleaning device F comprises a casing 4, a filter member 5, and a plurality of electric heaters 6 which are closely fixed to the upstream end surface of the filter member 5.

The reference numeral 7 designates a separator for dividing the exhaust gas flowing passage formed within the casing 4 into one passage **40*a* and another passage (by-pass passge) 40*b*. The exhaust gas amount flowing into the by-pass passage 40*b* is controlled by a control valve 8**.

The reference numeral 9 designates a differential pressure sensor for measuring the differential pressure between the upstream side and the downstream side of the filter member 5 and detecting the pressure loss of the exhaust gases passing the filter member 5. 10 designates a temperature sensor for detecting the temperature of the exhaust gases on the downstream side of the filter member 5. 11 designates a rotating speed sensor for detecting the rotating speed of the engine 1. 12 designates a control circuit for calculating the particulates accumulating degree of the filter member 5 from the output signals from the differential pressure sensor 9, the temperature sensor 10 and the rotating speed sensor 11 and supplying output signals to the electric heaters 6 and the control valve 8 when the particulates accumulating degree exceeds a predetermined amount. 13 designates a battery, 14 designates a heater switch for supplying an electric power to the electric heaters 6 from the battery 13 upon receiving the output signals from the control circuit 12. 15 designates a valve actuator for operating the control valve 8 upon receiving the output signals from the control circuit 12.

The by-pass passage **40*b* has a flowing resistance much smaller than that of the filter member 5 and has such a cross sectional area that most part of the exhaust gases flow into the by-pass passage 40*b* when the control valve 8** is fully opened.

In operation, while the exhaust gases discharged from the internal combustion engine 1 through the exhaust manifold 2 and the exhaust pipe 3 pass the filter member 5, the exhaust particulates contained within the exhaust gases are collected by the filter member 5. During the exhaust particulates collecting time, the control valve 8 is operated to close the by-pass passage **40*b***.

As the exhaust particulates collecting operation proceeds, the flowing resistance of the filter member 5 gradually increases. The increase in flowing resistance is observed by detecting the differential pressure between both sides of the filter member 5 by the differential pressure sensor 9. This differential pressure also varies broadly with the change of the exhaust gas temperature and the change of the engine rotating speed. By removing the influence of the exhaust gas temperature and the engine rotating speed from the obtained differential pressure, true flowing resistance of the filter member 5, namely, exhaust particulates accumulating degree can be obtained.

When the exhaust particulates accumulating degree reaches a predetermined amount, output signals are supplied to the valve actuator 15 from the control circuit 12.

Then, the control valve 8 operates to open the by-pass passage **40*b* so that the exhaust gas amount flowing through the passage 40*a*** is decreased.

Namely, when the by-pass passage **40*b* is opened, almost all of the exhaust gases flow into the by-pass passage 40*b* of which pressure loss is much smaller than that of the filter member 5 and only a small amount of exhaust gases flow into the filter member 5**.

Then, an electric current is applied to the electric heaters 6 provided in the filter member 5 to generate heat. The exhaust particulates collected by the filter member 5 in contact with the heaters 6 are heated and starts burning. The flame expands towards the downstream side of the filter member 5 to burn off the exhaust particulates collected therein. In this case, since a small amount of exhaust gases flow into the filter member 5, oxygen is supplied to the filter member 5 so that the exhaust particulates can be completely burnt off. The exhaust gas amount to be supplied to the filter member 5 is determined by the difference between the flowing resistance of the filter member 5 and that of the by-pass passage 40*b*.

Since the exhaust gas amount flowing into the filter member is small as described above, the heating efficiency of the heaters 6 is not reduced.

Figure 2:
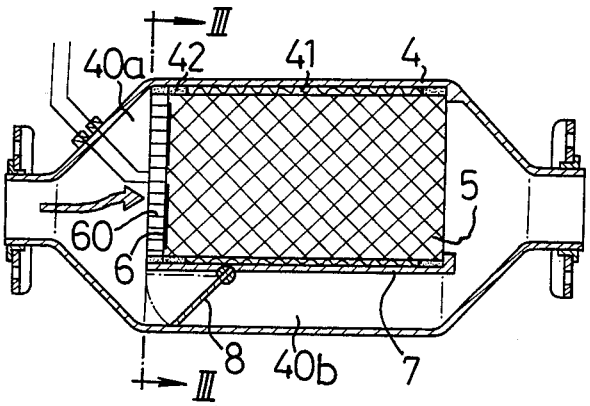
FIG. 2 is a longitudinal sectional view of a first embodiment of an exhaust particulates cleaning device according to the present invention at the particulates collecting time.
Figure 3:
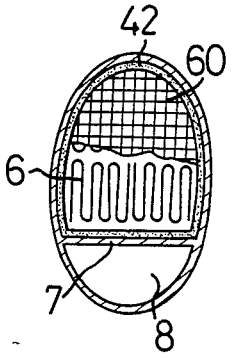
FIG. 3 is a transverse sectional view taken along the line III—III of FIG. 2.
Figure 4:
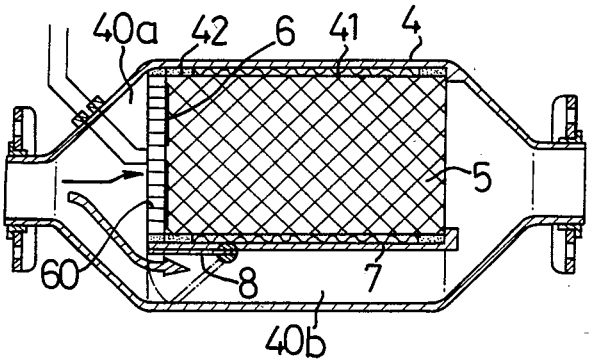
FIG. 4 is a longitudinal sectional view of a first embodiment at the filter regenerating time.

FIGS. 2 to 4 illustrate a first embodiment of the exhaust gas cleaning device according to the present invention.

The cylindrical casing 4 having an elliptical cross section defines exhaust gas passages 40*a*, 40*b* which are separated by the separator 7.

The filter member 5 is disposed in the exhaust gas passage 40*a* and elastically supported by a wire net 41 and a sealing member 42.

The filter member 5 is made of a ceramic foamed body, for example.

The control valve 8 is turnably supported within the exhaust gas passage(by-pass passage)40*b*. The exhaust gas amount flowing into the by-pass passage 40*b* is controlled by the turning of the control valve 8.

Nichrome wire heaters 6 are disposed on the upstream end surface of the filter member 5. The heaters 6 are fixed by a ceramic honeycomb body 60 which is provided so as to cover the heater 6. The ceramic honeycomb body 10 serves as a heater pushing means and a thermal insulator.

At the exhaust particulates collecting time, the control valve 8 turns and closes the by-pass passage 40*b*. All amount of exhaust gases flow into the upper exhaust gas passage 40*a* as shown in FIG. 2 and after the exhaust particulates are collected by the filter member 5, the exhaust gases flow out of the filter member 5.

When the collecting amount of exhaust particulates reaches a predetermined amount, the control valve 8 turns to open the by-pass passage 40*b*. As a result, almost all of the exhaust gases flow into the by-pass passage 40*b* as shown in FIG. 4. At the same time, an electric current is applied to the heaters 6 to ignite the exhaust particulates collected near the upstream end surface of the filter member 5. The combustion of the particulates expands to those collected in the downstream portion of the filter member 5. Consequently, the filter member 5 is regenerated.

When the regeneration of the filter member 5 is completed, the control valve 8 turns to close the by-pass passage 40*b*. Then, almost all of exhaust gases begin to flow into the filter member 5 again and the filter member 5 restarts collecting the exhaust particulates.

Figure 5:
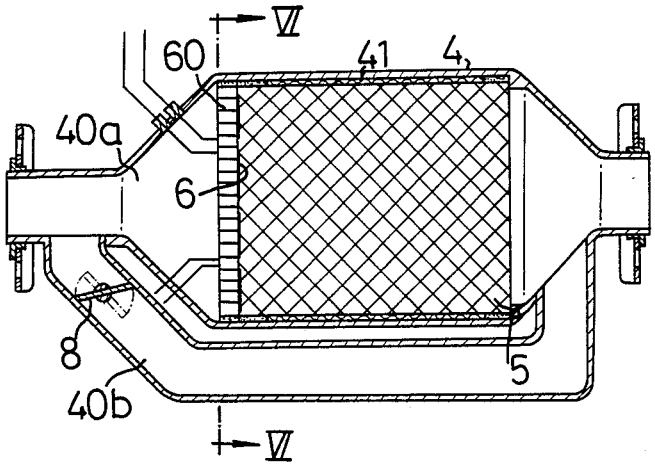
FIG. 5 is a longitudinal sectional view of a second embodiment of the exhaust particulates cleaning device according to the present invention.
Figure 6:
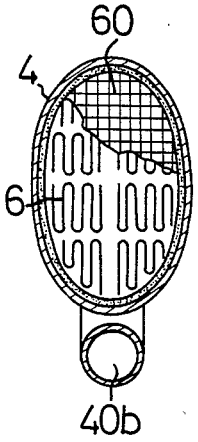
FIG. 6 is a transverse sectional view taken along the line VI—VI of FIG. 5.

FIGS. 5 and 6 illustrate a second embodiment of the exhaust particulates cleaning device according to the present invention.

The by-pass passage 40*b* is formed separately from the casing 4.

The control valve 8 is disposed in the by-pass passage 40*b*.

The other structure and operation of the second embodiment are substantially equal to those of the first embodiment.

According to the second embodiment, the by-pass passage 40*b* can be formed only by slightly changing the structure of the conventional casing for retaining the filter member.

Figure 7:
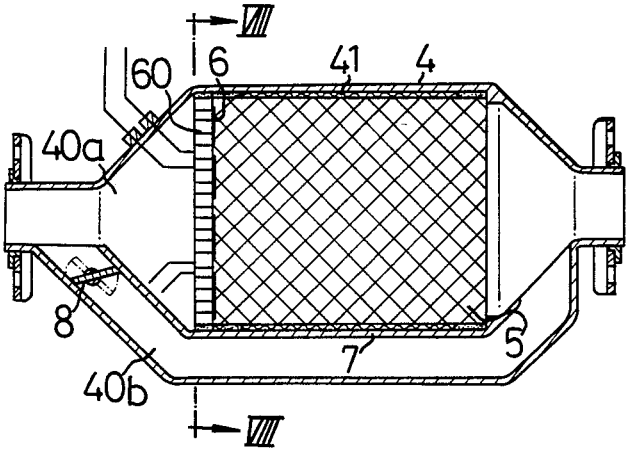
FIG. 7 is a longitudinal sectional view of a third embodiment of the exhaust particulates cleaning device according to the present invention.
Figure 8:
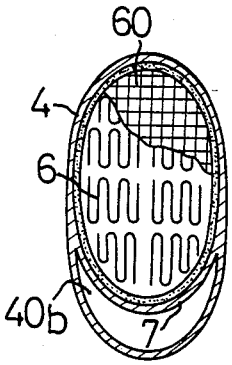
FIG. 8 is a transverse sectional view taken along the line VIII—VIII of FIG. 7.

FIGS. 7 and 8 illustrate a third embodiment of the exhaust particulates cleaning device according to the present invention.

In the third embodiment, the by-pass passage 40*b* is formed so as to have a crescent cross section.

Since the surface area of the separator 7 which defines the exhaust gas passages 40*a*, 40*b* is large, the heat of the exhaust gases flowing through the by-pass passage 40*b* is easily transmitted to the filter member 5 at the filter regenerating time. Therefore, the filter member 5 is effectively maintained at higher temperature.

Figure 9:
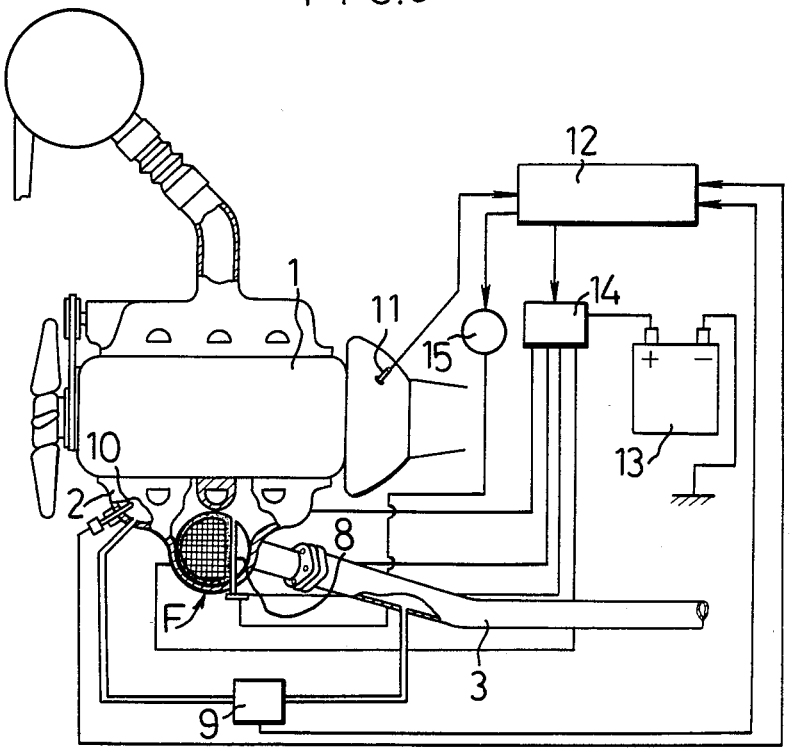
FIG. 9 is a schematic view of an engine exhaust system of which exhaust manifold is provided with an exhaust particulates cleaning device according to the present invention.
Figure 10:
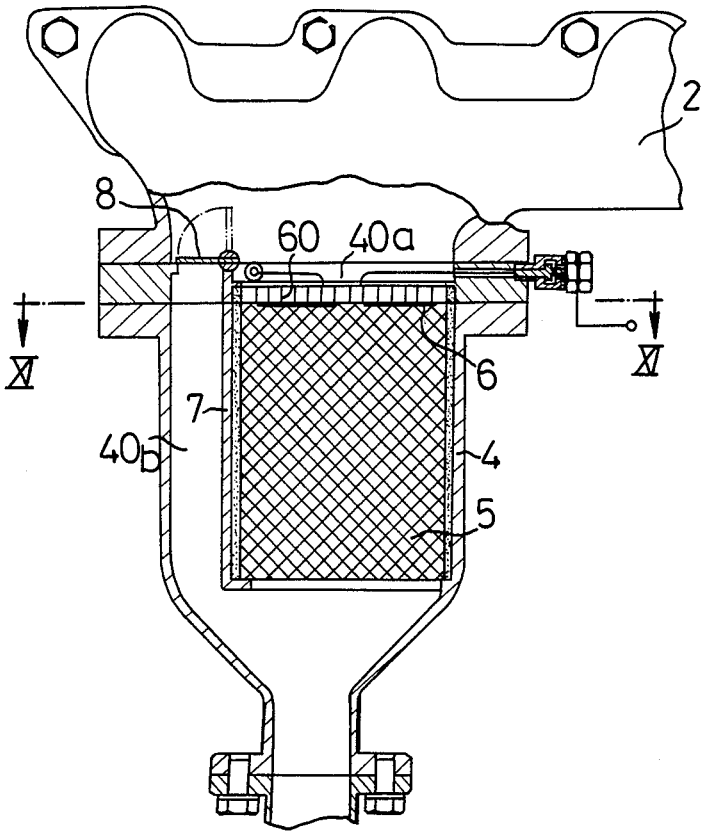
FIG. 10 is a longitudinal sectional view of a fourth embodiment of the exhaust particulates cleaning device according to the present invention, which is mounted on an exhaust manifold of an engine.
Figure 11:
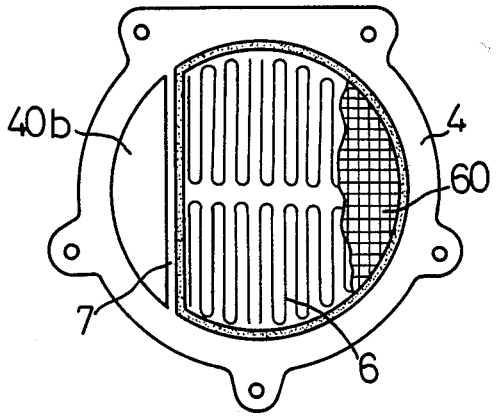
FIG. 11 is a transverse sectional view taken along the line XI—XI of FIG. 10.

FIGS. 9, 10, 11 illustrate a fourth embodiment of the exhaust particulates cleaning device according to the present invention.

In the fourth embodiment, the casing 4 comprising the exhaust gas passage 40*a* for retaining the filter member 5 and the by-pass passage 40*b* wherein the control valve 8 is disposed, is mounted on the outlet end portion of the exhaust manifold 2.

The exhaust gas passage 40*a* and the by-pass passage 40*b* are separated by the separator 7.

The other sturcture of the fourth embodiment is substantially equal to that of the first embodiment.

According to the fourth embodiment, the filter member 5 is positioned close to the outlet end portion of the exhaust manifold 2. Therefore, higher temperature exhaust gases flow into the filter member 5 so that the filter member 5 can be maintained at higher temperature. In addition, the casing 4 can be made compact.

Figure 12:
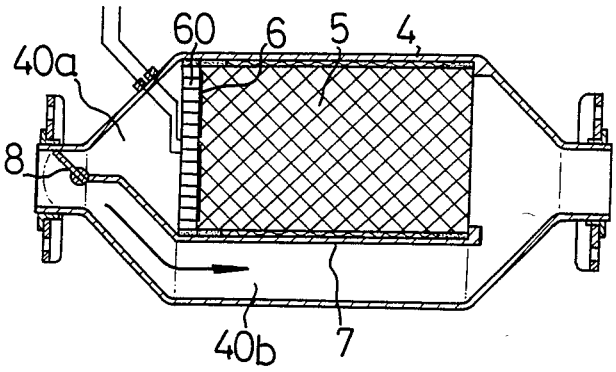
FIG. 12 is a longitudinal sectional view of a fifth embodiment of the exhaust particulates cleaning device according to the present invention.

FIG. 12 illustrates a fifth embodiment of the exhaust particulates cleaning device according to the present invention.

The space within the casing 4 is divided into two exhaust gas passages 40*a*, 40*b* by the separator 7 which extends toward the inlet end of the casing 4. In the exhaust gas passage 40*a* having a larger cross sectional area, the filter member 5 is disposed.

The exhaust gas control valve 8 is turnably fixed to the upper stream end of the separator 7. The valve 8 has such a shape and size that a small gap exists between the valve 8 and the inner wall of the casing 4 when the valve 8 closes the exhaust gas passage 40*a*. Therefore, when the exhaust gas passage 40*a* is closed by the valve 8, a small amount of exhaust gases flow into the exhaust gas passage 40*a*.

The other structure of the fifth embodiment is substantially equal to that of the first embodiment.

In the fifth embodiment, at the exhaust particulates collecting time, the exhaust gas passage 40*b* is closed by the control valve 8 so that all of the exhaust gases flow into the filter member 5. At the filter member regenerating time, the exhaust gas passage 40*a* is closed by the valve 8 and an electric current is applied to the heaters 6.

At this time, a small amount of exhaust gases is supplied to the filter member 5 through the gap between the valve 8 and the casing 4 so as not to reduce the heating efficiency of the heaters 6.

The collected exhaust particulates are ignited by the heaters 6 and the combustion of the collected particulates continues since oxygen is supplied to the filter member 5 from the exhaust gases flowing thereinto.

Figure 13:
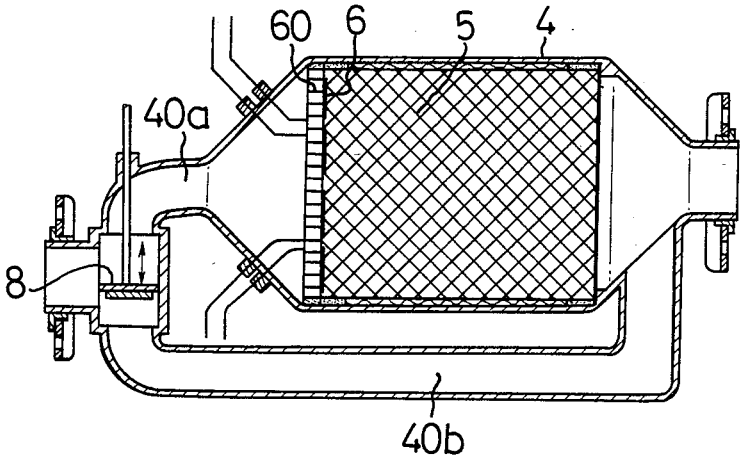
FIG. 13 is a longitudinal sectional view of a sixth embodiment of the exhaust particulates cleaning device according to the present invention.

FIG. 13 illustrates a sixth embodiment of the exhaust particulates cleaning device according to the present invention.

In the sixth embodiment, the exhaust gas passages 40*a*, 40*b* are communicated with each other through a cylindrical pipe.

Into the cylindrical pipe, the control valve 8 of a piston type is slidably inserted.

According to the sixth embodiment, the exhaust gas amount flowing into the exhaust gas passages 40*a*, 40*b* is controlled by the upward and downward movement of the control valve 8.

Figure 14:
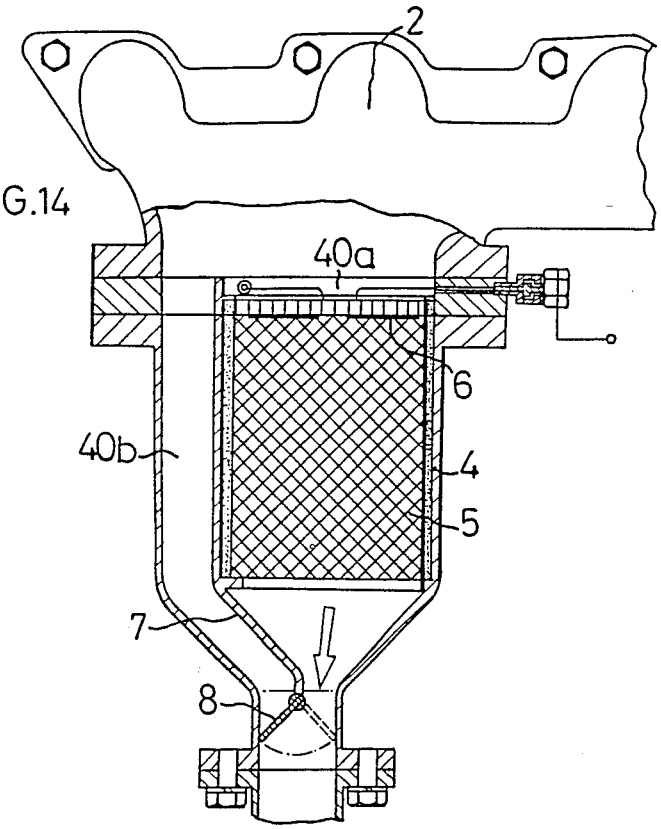
FIG. 14 is a longitudinal sectional view of a seventh embodiment of the exhaust particulates cleaning device according to the present invention.

FIG. 14 illustrates a seventh embodiment of the exhaust particulates cleaning device according to the present invention.

In the seventh embodiment, the casing 4 which retains the filter member 5 and is provided with the by-pass passage 40*b* like the fourth embodiment shown in FIG. 10 is mounted to the outlet end portion of the exhaust manifold 2.

The exhaust gas control valve 8 is turnably fixed to the end of the separator 7 which extends toward the outlet end of the casing 4.

As shown in the seventh embodiment, by providing the control valve 8 on the downstream side of the exhaust gas passages 40*a*, 40*b*, the exhaust gas amount flowing into each of the passages 40*a*, 40*b* can be also controlled.

Hereinafter, a valve actuator for supplying the most proper amount of exhaust gases into the filter member at the filter member regenerating time in accordance with the engine driving condition, will be explained.

As described above, a small amount of exhaust gases are required for continuing the combustion of the collected particulates at the filter member regenerating time.

For example, in the first embodiment shown in FIGS. 2 to 4, the exhaust gases of which amount is determined by the difference in pressure loss between the exhaust gas passage 40*a* and the by-pass passage 40*b*, flow into the exhaust gas passage 40*a* at the filter member regenerating time.

In the fifth embodiment shown in FIG. 12, by forming the valve 8 so as to produce a small gap between the valve 8 and the inner wall of the casing 4 when the valve 8 closes the exhaust gas passages 40*a*, a small amount of exhaust gases flow into the exhaust gas passage 40*a* at the filter member regenerating time.

The exhaust gas amount discharged from the engine, broadly changes in accordance with the driving condition such as an engine rotating speed.

Therefore, when the engine rotaing speed is high, an excess amount of exhaust gases are supplied to the filter member 5 at the filter member regenerating time so that the heating efficiency of the heater member is reduced.

When the engine rotating speed is low, the supplying amount of exhaust gases is too small to continue the combustion of the ignited exhaust particulates.

Figure 15:
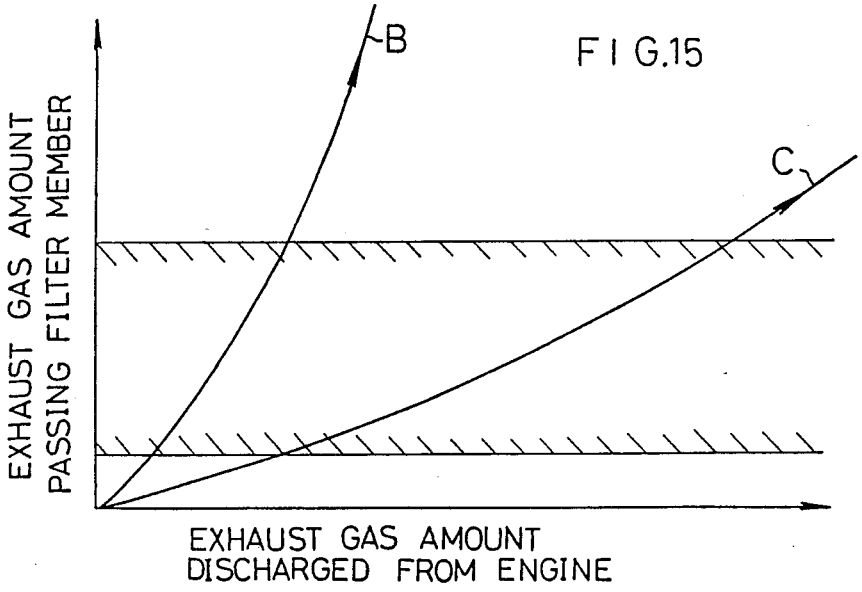
FIG. 15 is a graph showing the relation between the exhaust gas amount discharged from an engine and that passing the filter member of the present invention.

FIG. 15 is a graph showing the relation between the exhast gas amount discharged from the engine, which is plotted on the abscissa and the exhaust gas amount passing the filter member, which is plotted on the ordinate. The region defined by oblique lines shows the region of the exhaust gas amount suitable for the regeneration of the filter member.

The curve C shows the above relation when the control valve 8 of the first embodiment is full-open. In this case, when the exhaust gas amount discharged from the engine is small, a sufficiently large amount of exhaust gases enough to regenerate the filter member are not supplied to the filter member.

The curve B shows the above relation when the control valve 8 is half-open. In this case, even when the discharged exhaust gas amount is small, enough exhaust gas amount passing the filter member to regenerate the filter member can be obtained.

Namely, when the exhaust gas amount discharged from the engine is large, the valve 8 should be full-open while when the above amount is small, the valve 8 should be half-open.

As described above, by controlling the opening degree of the by-pass passage in accordance with the exhaust gas amount discharged from the engine, the filter member can be effectively regenerated in any engine driving condition.

Figure 16:
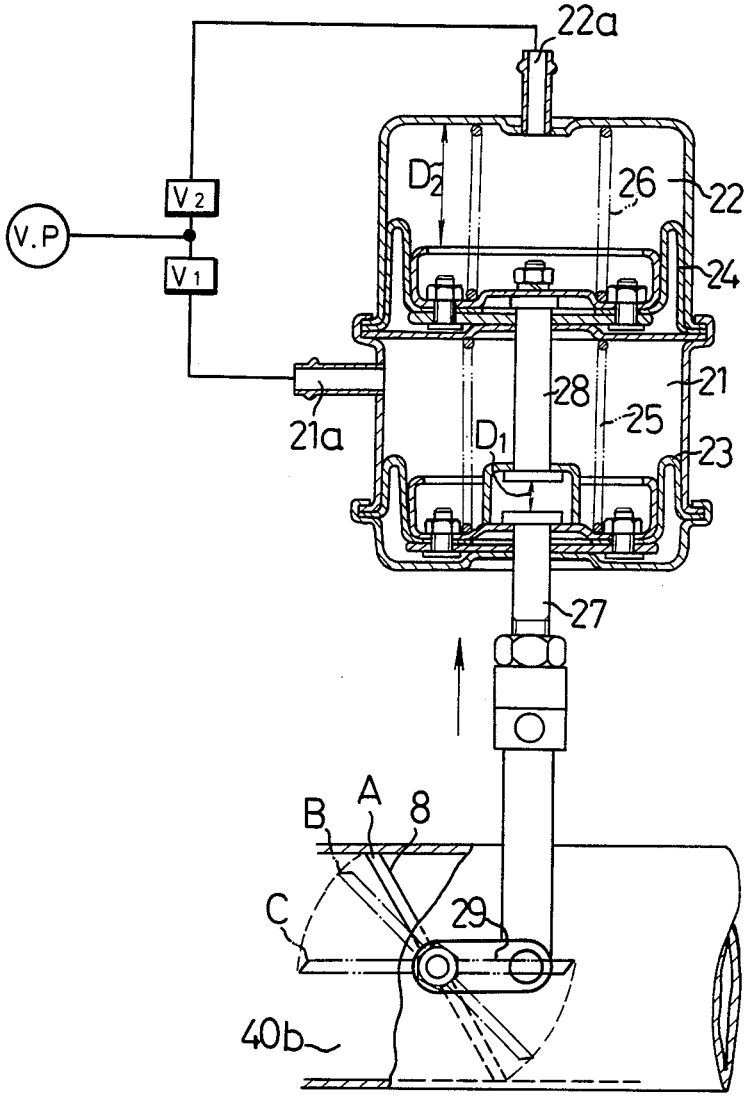
FIG. 16 is a longitudinal sectional view of a first embodiment of a valve actuator for controlling the valve of the exhaust particulates cleaning device of the present invention.

FIG. 16 illustrates a first embodiment of a valve actuator which is employed in the present invention.

In the first embodiment, the valve actuator comprises a first vacuum housing 21 and a second vacuum housing 22, which are separated from each other. Within the vacuum housings 21, 22, a bellowphragms 23, 24 and springs 25, 26 are accomodated, respectively. A rod 27 driven by the bellowphragm 23 is coaxially opposed to a rod 28 driven by the bellowphragm 24. The rods 27 and 28 relatively moves by the distance $D_1$.

When the valve 8 is set half-open shown by "B" in FIG. 16, an electric current is applied to an electromagnetic valve $V_1$ to apply a negative pressure from a vacuum pump V.P. to the first vacuum housing 21 through an opening 21*a*. Then, the rod 27 moves by the distance $D_1$ upward so that the arm 29 connected to the rod 27 turns to set the valve 8 into the position "B".

When the valve 8 is set full-open shown by C in FIG. 16, an electric current is applied to an electromagnetic valve $V_2$ to apply a negative pressure from the vacuum pump V.P. to the second vacuum housing 22 through an opening 22*a*. The rod 28 is pulled upward by the maximum stroke of $D_2$ so that the arm 29 connected to the rod 28 through the rod 27 turns to set the valve 8 into the position "C".

When the exhaust particulates are collected by the filter member 5, the valve 8 is set closed (position "A"). When the engine rotating speed is under a predetermined value so that the exhaust gas amount discharged from the engine is small at the filter member regenerating time, an electric current is applied to the electromagnetic valve $V_1$ to set the valve 8 half-open (position "B") and when the engine rotating speed is over a predetermined value, an electric current is applied to the electromagnetic valve $V_2$ to set the valve 8 full-open (position "C").

The opening degree of the half-opening valve 8 is freely controlled by adjusting the stroke $D_1$ in accordance with the engine driving condition.

Figure 17:
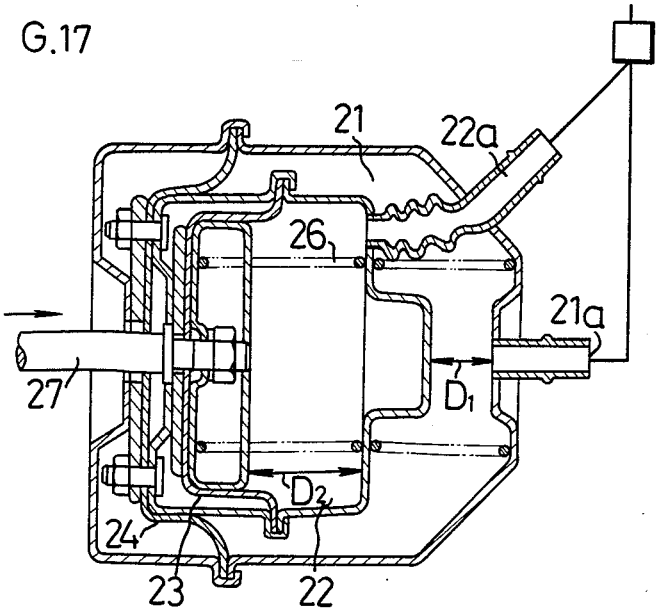
FIG. 17 is a longitudinal sectional view of a second embodiment of the valve actuator.

FIG. 17 illustrates a second embodiment of the valve actuator.

In the second embodiment, the first vacuum housing 21 is formed so as to surround the second vacuum housing 22. By applying a negative pressure to the housing 21 or 22, the second housing 22 or the rod 27 moves by the stroke $D_1$ or $D_2$.

Figure 18:
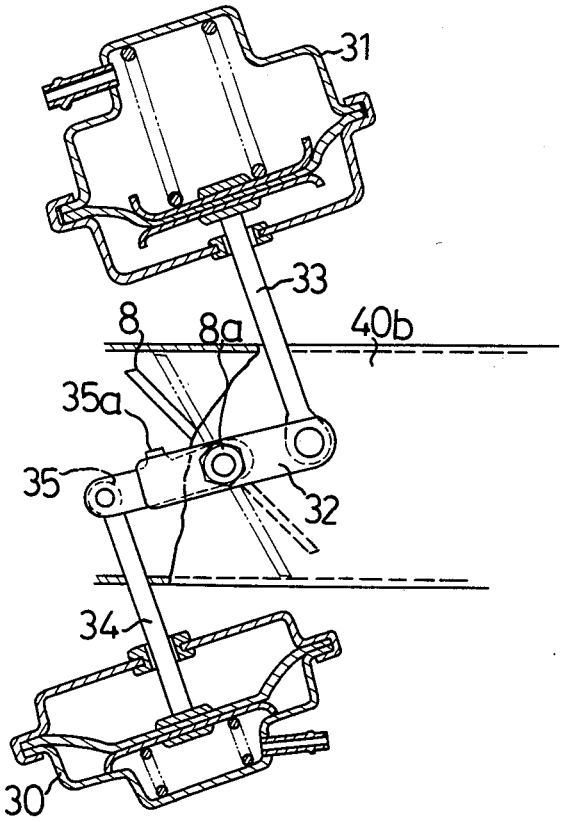
FIG. 18 is a longitudinal sectional view of a third embodiment of the valve actuator.

FIG. 18 illustrates a third embodiment of the valve actuator.

In the third embodiment, an actuator 30 for setting the valve 8 half-open, and an actuator 31 for setting the valve 8 full-open are separately provided.

The rod 34 of the actuator 30 is turnably connected to the arm 35 which is turnably supported by a rotating shaft 8*a* of the valve 8.

The rod 33 of the actuator 31 is turnably connected to the arm 32 which is fixed to the shaft 8*a*.

When the valve 8 is set half-open, a negative pressure is applied to the actuator 30 to pull the rod 34 downward so that the arm 35 turns. Then, a projecting portion 35*a* formed in the arm 35 engages with the arm 32 to turn the arm 32 counterclockwise. Consequently, the valve 8 turns to its half-open position.

When the valve 8 is full-open, a negative pressure is applied to the actuator 31 to pull the arm 33 upward so that the arm 32 disengages from the projecting portion 35*a* and turns counterclockwise. Consequently, the valve 8 turns to its full-open position.

The opening degree of the valve 8 can be controlled by detecting the engine rotating speed and the intake air amount.

In the above embodiments, the exhaust gas amount passing the filter member is controlled by detecting the change of the exhaust gas amount discharged from the engine by some means and adjusting the opening degree of the control valve in accordance with the detected data.

In the following embodiment, the control valve itself has an exhaust gas amount controlling property.

Figure 19:
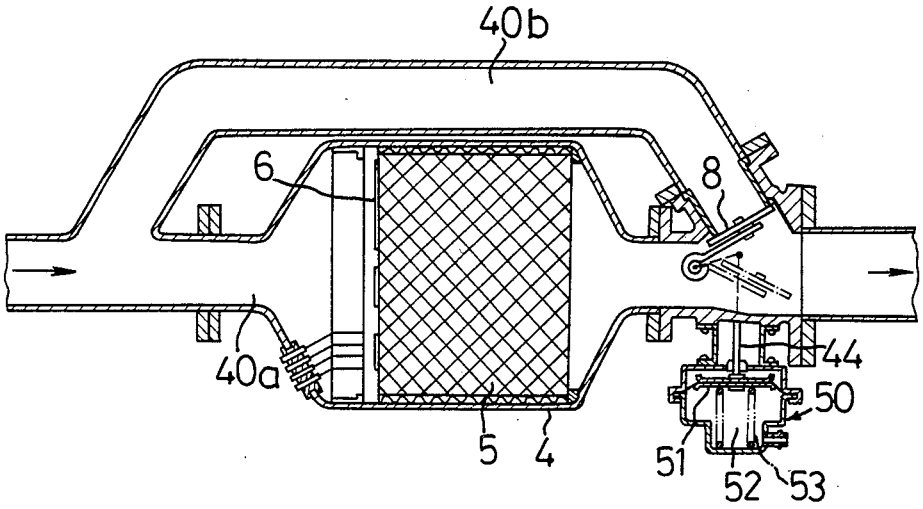
FIG. 19 is a longitudinal sectional view of the exhaust particulates cleaning device which is provided with a fourth embodiment of the valve actuator.
Figure 20:
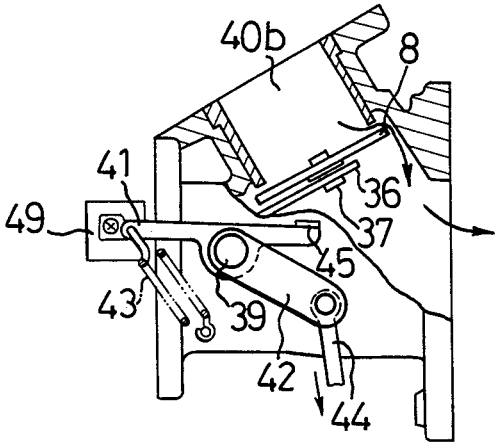
FIG. 20 is a longitudinal sectional view of the main part of the fourth embodiment of the valve actuator.

FIGS. 19 and 20 illustrate a fourth embodiment of the valve actuator which controls the exhaust gas amount passing the filter member into a proper amount regardless of the engine driving condition at the filter member regenerating time.

As shown in FIG. 19, in the exhaust gas passage 40*a*, the filter member 5 is disposed.

At the downstream connecting portion of the exhaust gas passage 40*a* and the by-pass passage 40*b*, the valve 8 is provided.

The differential pressure between the upstream side and the downstream side of the filter member 5 changes nearly in proportion to the flow rate of exhaust gases passing the filter member 5.

Since the valve 8 is provided at the downstream end of the by-pass passage 40*b* so as to face the downstream end of the exhaust gas passage 40*a*, the differential pressure between the upstream side and the downstream side of the valve 8 is nearly equal to that of the filter member 5.

Therefore, by keeping the differential pressure between the upstream side and the downstream side of the valve 8 constant in any driving condition, the differential pressure of the filter member 5 can be also kept constant so that the exhaust gas amount passing the filter member 5 can be kept constant.

The valve 8 is fixed to one end of a first arm 36 while the other end of the arm 36 is fixed to the shaft 39 which is turnably supported by the casing 4.

To the shaft 39, the central portion of a second arm 41 is fixed. And one end of a third arm 42 is turnably supported by the shaft 39.

One end of a spring 43 is fixed to the second arm 41 so as to urge the arm 41 counterclockwise while the other end of the spring 43 is fixed to the casing 4.

One end of the rod 44 is turnably supported by the other end of the third arm 42 while the other end of the rod 44 is connected to a bellowphragm 51 of an actuator 50.

In the other end of the second arm 41, a projecting portion 45 is formed so as to contact with the third arm 42 when the arm 42 turns.

At the exhaust particulates collecting time, the rod 44 is pushed upward by a spring 53 of the actuator 50 through the bellowphragm 51. The third arm 42 turns counterclockwise about the shaft 39 to engage with the projecting portion 45. As a result, the arm 41 turns with the arm 42 so that the valve 8 is pushed to the downstream end of the by-pass passage 40*b*.

Therefore, the by-pass passage 40*b* is closed and all of the exhaust gases flow into the filter member 5.

At the filter member regenerating time, a negative pressure is applied to a vacuum housing 52 of the actuator 50 to pull the bellowphragm 51 downward. The third arm 42 connected to the bellowphragm 51 through the rod 44 disengages from the projecting portion 45 and turns clockwise as shown in FIG. 20.

Therefore, at this time, the valve 8 is pushed toward the downstream end of the by-pass passage 40*b* only by the spring 43.

Since the biasing force of the spring 43 is not so large, the exhaust gas pressure applied from the by-pass passage 40*b* overcomes the biasing force of the spring 43 to set the valve 8 half-open.

The opening degree of the valve 8 changes in accordance with the amount of exhaust gases flowing into the by-pass passage 40*b*. Consequently, the pressure difference between the upstream side and the downstream side of the valve 8 can be kept nearly constant in any engine driving condition.

Therefore, the pressure difference between the upstream side and the downstream side of the filter member 5 can be also kept nearly constant so taht the exhaust gas amount passing the filter member 5 at the filter member regenerating time can be kept constant regardless of the exhaust gas amount discharged from the engine.

The constant exhaust gas amount passing the filter member 5 can be adjusted by selecting the biasing force of the spring 43.

A weight 49 is provided at one end of the arm 41 for preventing the valve 8 from vibrating due to the pulsation of exhaust gases.

Figure 21:
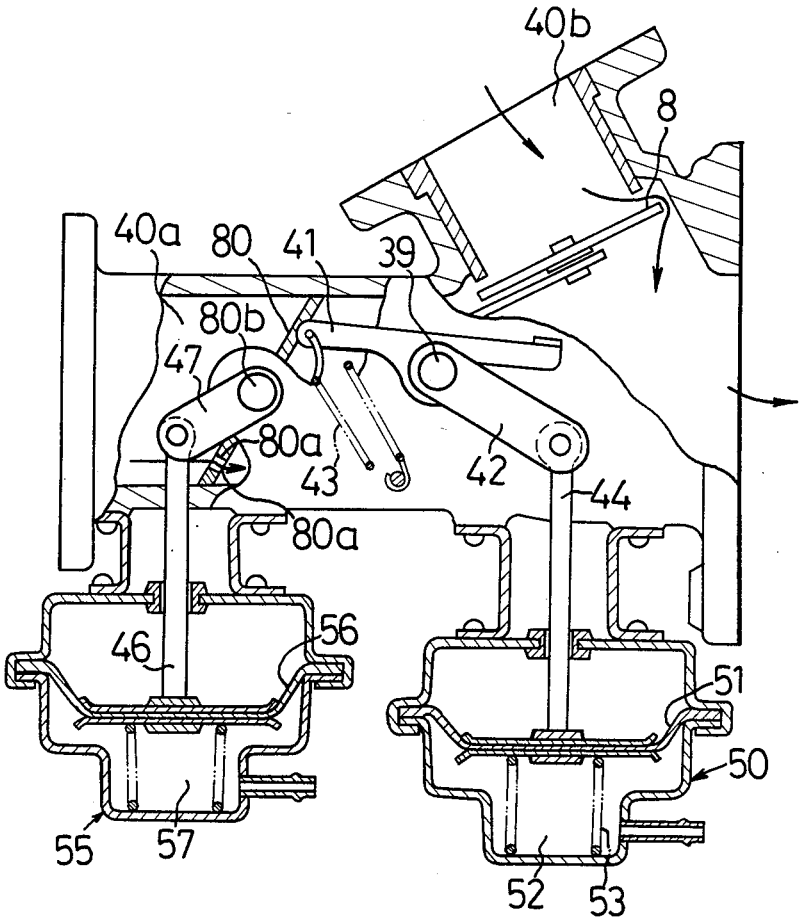
FIG. 21 is a longitudinal sectional view of a fifth embodiment of the valve actuator at the filter regenerating time.
Figure 22:
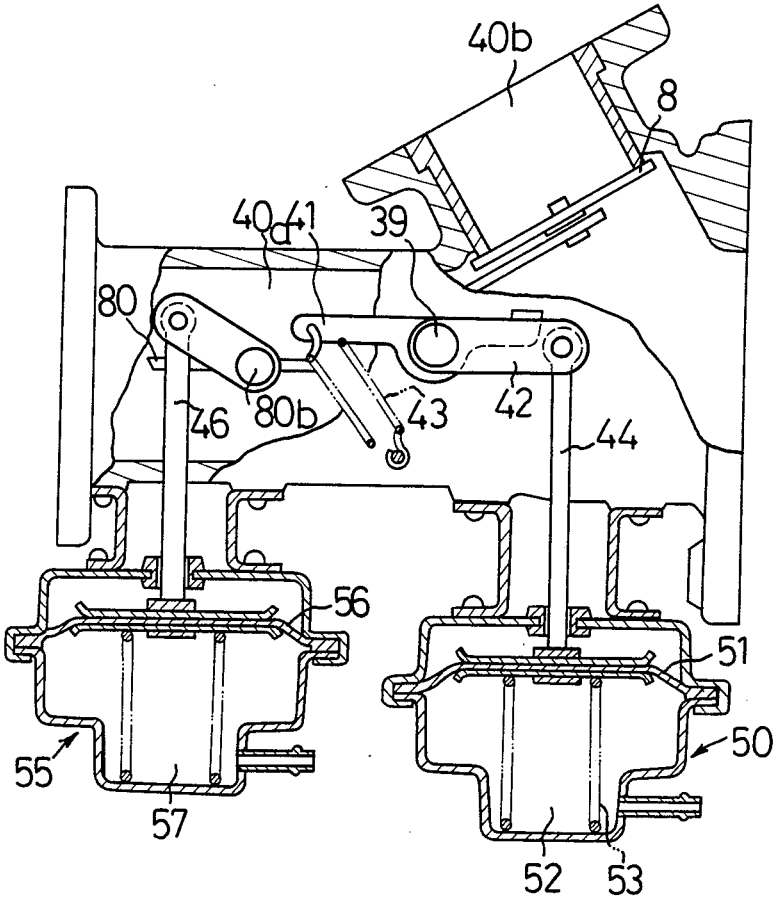
FIG. 22 is a longitudinal sectional view of the fifth embodiment of the valve actuator at the exhaust particulates collecting time.

FIGS. 21, 22 illustrate a fifth embodiment of the valve actuator.

In this embodiment, a butterfly valve 80 is further provided for restricting the exhaust gas amount passing the filter member at the filter member regenerating time.

At the filter member regenerating time, the opening degree of the valve 8 which is biased by the spring 43, changes in accordance with the differential pressure between the upstream side and the downstream side of the filter member.

When the filter member having a low flowing resistance is used, the differential pressure between the upstream side and the downstream side of the filter member must be made especially small at the filter member regenerating time by decreasing the biasing force of the spring 43.

However, when the biasing force of the spring 43 is decreased, the rotating resistance of the shaft 39 relatively increases so that the opening degree of the valve 8 cannot be accurately adjusted.

The valve 80 is provided for preventing the occurrance of the adjusting error. The valve 80 closes the exhaust gas passage 40*a* at the filter member regenerating time to increase the apparent flowing resistance of the filter member.

By providing the valve 80 in the exhaust gas passage 40*a*, the exhaust gas amount passing the filter member can be accurately controlled without decreasing the biasing force of the spring 43.

In order to operate the valve 80, a second valve actuator 55 of the same type as that of the actuator 50, is provided. In the exhaust gas passage 40*a*, the valve 80 provided with a plurality of small passages 80*a* is disposed on the downstream side of the filter member (not shown).

The second actuator 55 comprises a bellowphragm 56 to which one end of the rod 46 is fixed.

The other end of the rod 46 turnably connected to one end of an arm 47 while the other end of the arm 47 is fixed to a rotating shaft **80*b* of the valve 80**.

The other structure of this embodiment is substantially equal to that of the fourth embodiment shown in FIG. 20.

FIG. 21 illustrates the operation of the valves 8, 80 at the filter member regenerating time.

A negative pressure is applied to vacuum housings 52, 57 of the valve actuators 50, 55, respectively. As a result, the valve 8 closes the by-pass passage **40*b* only by the biasing force of the spring 43 and the valve 80 closes the exhaust gas passage 40*a*** on the downstream side of the filter member.

Differential pressure between the upstream side and the downstream side of the filter member increases as well as that between the upstream side and the downstream side of the valve 8 so that the valve 8 opens the by-pass passage **40*a*, overcoming the biasing force of the spring 43**.

The opening degree of the valve 8 changes in accordance with the change of pressure difference. Therefore, in any driving condition, a proper amount of exhaust gases pass the filter member.

FIG. 22 illustrates the operation of the valves 8, 80 at the exhaust particulates collecting time.

At this time, a negative pressure is not supplied to the actuators 50, 55, respectively so that the valve 8 closes the by-pass passage **40*b* and the valve 80** is fully opened.

As described above, according to the present invention, almost all amount of exhaust gases pass the filter member at the exhaust particulates collecting time, and exhaust particulates contained therewithin are collected by the filter member.

At the filter member regenerating time, the exhaust gas amount passing the filter member can be accurately adjusted into the minimum amount anough to continue the combustion of the collected exhaust particulates.

Therefore, the heating efficiency of the heater is not reduced.

In addition, since exhaust gases containing enough amount of oxygen to continue the combustion of the exhaust particulates are supplied to the filter member at the filter member regenerating time, all of the exhaust particulates can be completely burnt off.

Furthermore, according to the present invention, at the filter member regenerating time, the most proper amount of exhaust gases can be supplied to the filter member regardless of the change of the exhaust gas amount discharged from the engine.

What is claimed is:

1. An exhaust gas cleaning device for collecting exhaust particulates contained within exhaust gases discharged from an internal combustion engine, and burning off the collected exhaust particulates, comprising:

a casing provided in an exhaust gas of said internal combustion engine;

a filter member, within said casing, for collecting exhaust particulates within said exhaust gases;

an electrically heating member for heating and igniting said exhaust particulates collected by said filter member, which heating member is positioned upstream of said filter member;

means for detecting an amount of exhaust particulates collected by said filter means;

a heating member control means for operating said heating member when said detecting means detects a predetermined collected amount of exhaust particulates;

a by-pass passage for permitting exhaust gases to by-pass said filter member, which communicates with the upstream end portion and the downstream end portion of said casing; and a valve plate member which can be positioned either for closing said by-pass passage and flowing all of the exhaust gases into said filter member or opening said by-pass passage to flow almost all of the exhaust gases into said by-pass passage while permitting a small amount of exhaust gases to flow into said filter member; and valve control means for controlling the position of said valve plate member such that the by-pass passage is closed when the particulate amount is under said predetermined amount, and the by-pass passage is opened to a degree determined by the amount of exhaust gas discharged by the engine when the particulate amount is above said predetermined amount.

2. An exhaust gas cleaning device according to claim 1, wherein said valve plate member is provided in an upstream end portion of said by-pass passage.

3. An exhaust gas cleaning device according to claim 2, wherein:

said valve plate member is provided in an upstream portion of said casing which communicates with said by-pass passage; said valve plate member turns to selectively open or close an exhaust gas passage leading to said filter member and said by-pass passage; and said valve plate has such a shape and size as to form a gap between said valve plate and a wall defining said exhaust gas passage, enough to supply said small amount of exhaust gases into said filter member when said exhaust gas passage is closed by said valve plate.

4. An exhaust gas cleaning device according to claim 1, wherein:

said casing and said by-pass passage are integrally formed and mounted on an outlet end of an exhaust manifold of said internal combustion engine.

5. An exhaust gas cleaning device according to claim 1 further comprising: engine rotating speed detecting means for detecting an engine rotating speed with which the exhaust gas amount discharged from said engine varies and providing a rotation signal indicative thereof to said valve control means which in turn controls said valve plate member at least in part as a function of said rotation signal.

6. An exhaust gas cleaning device according to claim 5, wherein said valve control means comprises:

two bellowphragms which operate with predetermined strokes different from each other when a negative pressure is applied thereto, a link mechanism for selectively connecting one of said bellowphragms to a rotating shaft of said valve plate to turn said valve plate by an opening degree determined by the stroke of each of said bellowphragms; and a negative pressure applying means for selectively applying a negative pressure to said bellowphragms in accordance with the exhaust gas amount discharged from said engine, wherein said negative pressure applying means stops applying a negative pressure to said bellowphragms in accordance with the exhaust particulates collected amount of said filter member is under said predetermined amount, and selectively applies a negative pressure to said bellowphragms to change the opening degree of said valve plate in accordance with the exhaust gas amount discharged from said engine when the exhaust particulates collected amount of said filter member is above said predetermined amount.

7. An exhaust gas cleaning device according to claim 6, wherein:

said negative pressure applying means applies a negative pressure to aid bellowphragm having a shorter stroke when the exhaust gas amount discharged from said engine is below said predetermined amount, and applies a negative pressure to said bellowphragm having a larger stroke when the exhaust gas amount discharged from said engine is above said predetermined amount.

8. An exhaust gas cleaning device according to claim 2, wherein:

said valve means comprises a valve plate which is provided in the downstream end of said by-pass passage, and a valve control means for operating said valve plate to close said by-pass passage when the exhaust particulates collected amount of said filter member is below a predetermined amount and to open said by-pass passage by the opening degree determined in accordance with the exhaust gas amount discharged from said engine when the exhaust particulates collected amount reaches a predetermined amount and said heating member operates thereby to keep the differential pressure between the upstream side and the downstream side of said valve plate constant.

9. An exhaust gas cleaning device according to claim 8, wherein:

said valve control means comprises a valve plate pushing means for applying a pushing force to said valve plate so as to close said downstream end of said by-pass passage when the exhaust particulates collected amount of said filter member is below a predetermined amount and releasing said valve plate from said pushing force when the exhaust particulates collected amount reaches a predetermined amount and said heating member operates; and a spring for applying a biasing force to said valve plate so as to close said downstream end of said by-pass passage; and said biasing force of said spring is set so that said valve plate is opened overcoming said biasing force of said spring by the opening degree determined by the differential pressure between the upstream side and the downstream side of said valve plate when said differential pressure reaches a predetermined amount.

10. An exhaust gas cleaning device according to claim 9, wherein:

said valve plate pushing means comprises a bellowphragm operated when a negative pressure is applied thereto; and a link mechanism which connects said rotating shaft of said valve plate to said bellowphragm.

11. An exhaust gas cleaning device according to claim 1 wherein said valve plate member is provided in a downstream end portion of said pass passage.

12. An exhaust gas cleaning device according to claim 6, wherein said negative pressure applying means is electrically connected to said engine rotating speed detecting means and applies a negative pressure to one of said bellowphragms upon receiving a signal indicating a predetermined engine rotating speed.

* * * * *